US005582197A

United States Patent [19]

Dobberstein

[11] Patent Number: 5,582,197

[45] Date of Patent: Dec. 10, 1996

[54] SOLAR TENT

[76] Inventor: Steven E. Dobberstein, 2324 E. 37th St., Minneapolis, Minn. 55406

[21] Appl. No.: 502,646

[22] Filed: Jul. 14, 1995

[51] Int. Cl.[6] ..... A45F 1/16

[52] U.S. Cl. ..... 135/87; 135/92; 135/97; 135/127; 135/137; 135/156; 135/120.3

[58] Field of Search ..... 135/87, 91, 92, 135/93, 95, 97, 127, 901, 137, 156, 122, 144, 143, 120.3, 120.1, 130, 131

[56] References Cited

U.S. PATENT DOCUMENTS

| | | | |
|---|---|---|---|
| 3,330,582 | 7/1967 | Morris | 135/120.3 X |
| 3,800,814 | 4/1974 | Hibbert | 135/93 |
| 3,941,140 | 3/1976 | Beavers | 135/120.3 X |
| 4,067,347 | 1/1978 | Lipinski | 135/92 X |
| 4,205,654 | 6/1980 | Jones, III | 126/440 |
| 4,265,261 | 5/1981 | Barker | 135/93 X |
| 4,320,744 | 3/1982 | Fodor et al. | 135/92 X |
| 4,590,956 | 5/1986 | Griesenbeck | 135/127 X |
| 4,719,935 | 1/1988 | Gustafson | 135/92 X |
| 4,858,634 | 8/1989 | McLeese | 135/143 X |
| 5,439,018 | 8/1995 | Tsai | 135/143 |

*Primary Examiner*—Wynn E. Wood
*Attorney, Agent, or Firm*—D. L. Tschida

[57] ABSTRACT

A multi-season, reversible tent adapted to accommodate prevailing solar conditions. Selected walls are constructed to include insulated liners and solar reflective and absorptive surfaces which cooperate with a longitudinal access opening. The walls assemble to an irregular triangular shape and can be reversed to optimally collect and reflect solar and thermal radiation in relation to one or more occupants and the prevailing conditions. Zippered reliefs at the door control the solar exposure of the wall surfaces and facilitate entry and egress. Multi-section, shock corded, end support frames are permanently contained at hemmed edges of the end walls. Adjoining pole ends are hinged to one another and longitudinal poles extend between eyelets at the hinge joints. Removeable cover, screen and window panels are supported to the door periphery. Rotating vents with overlapping apertures control interior temperature.

17 Claims, 9 Drawing Sheets

SOLAR TENT

BACKGROUND OF THE INVENTION

The present invention relates to portable shelters and, in particular, to a multi-season, reversible, self-contained tent configured to selectively collect or reflect solar energy depending upon daily weather conditions and user preference.

With the increasing popularity of outdoor activities, a resurgence of interest has occurred in the camping industry. A variety of tent designs have evolved to meet this demand. Such tents have been designed to meet a variety of user needs and seasonal conditions relative to various user groups which range from the occasional camper, to backpackers, to mountain climbers, to name a few.

Most current tent designs provide single layer, nylon fabric walls and multi-section support frames. The support frames may thread through sleeves at the walls or fit to external fasteners. Some tents include captured frames which store with the tent.

Depending upon the user group, the tents typically assemble to a walled cabin configuration or to a variety of geodesic shapes. For serious campers, the shapes and numbers of pole supports are configured to provide a low profile structure which is stable under windy conditions. For occasional users, fewer sections are typically provided, and the height of the tent is increased to permit standing. None of the tents are constructed to primarily accommodate solar conditions.

The tents may provide multiple doors. The doors typically are fitted at the end walls. Separate ground cloths are also frequently used with the tents. Complementary rain covers are frequently provided which separately mount over the tent to enhance weather resistance.

The colors of the dyed fabrics are typically selected to appeal to the aesthetic tastes of the consumer (e.g. greens, browns, blues and grey) which colors are the same on both the outside and inside surfaces of the tent. The tents are not reversible; and with a uniform color scheme the temperature of the tent interior is not susceptible to control. Instead, the user must understand and accept the potential temperature extremes that can occur within the tent and plan his/her use of the tent accordingly.

Triangular and A-frame tents are also known. Many traditional tents, such as used by boy and girl scouts, erect to isosceles triangle configurations. The tents erect to a low profile and are principally are used for sleeping accommodations. An access opening at an end wall permits entry and a covering rain fly may be separately supported above the tent. The tents are constructed of a single layer of canvas or nylon, which is supported to a detachable tubular frame.

In appreciation of the foregoing deficiencies, the invention provides a fabric tent wherein multi-layered fabric walls are constructed and arranged to be reversible and to selectively reflect or absorb solar radiation, depending upon the assembled configuration. The multi-paneled walls optimally reflect or collect solar and thermal radiation in cooperation with a longitudinal access door having removeable cover, screen and/or window panels and adjustable relief panels which vary the exposure. A self-contained, collapsible, hinged support frame facilitates storage and assembly.

SUMMARY OF THE INVENTION

It is accordingly a primary object of the invention to provide a tent configured to optimally collect or reflect solar and thermal energy in relation to changing environmental conditions on any given day of any given season.

It is a further object of the invention to provide a tent having multi-layered, fabric walls which are arranged to be reversible.

It is a further object of the invention to provide a tent having a door mounted in a longitudinal wall opposite exposed adjoining walls having insulated liners and solar collective and reflective surfaces.

It is a further object of the invention to provide a longitudinal access door bordered by magnetic fasteners and to which mating screen and/or transparent window or opaque covers can be selectively attached.

It is a further object of the invention to provide selectively fastened reliefs at the access door to increase the exposure area and to facilitate entry, egress and cleaning.

It is a further object of the invention to provide vents at the tent walls to control the interior conditions.

It is a further object of the invention to provide a tent having a self-contained support framework which assembles to a triangular shape, when viewed on end.

It is a further object of the invention to provide a tent having a self-contained, multi-section support framework wherein an elastic cord is suspended in the bore of a plurality of tubular sections which couple along their lengths and are hinged at adjoining ends.

Various of the foregoing objects advantages and distinctions of the invention are obtained in a presently preferred construction which provides a self-contained fabric walled tent having an irregular triangular shape. Adjoining walls opposite a longitudinal access door are configured from a number of layers which include a solar reflective layer, insulative layer and an opaque energy absorbant layer. Magnetic strip fasteners and zippers border the periphery of the door and selectively couple a number of removeable, opaque, transparent and/or screen panels to the door. Zippered reliefs at the door permit selective release of adjoining door flaps and increased exposure.

Folding, multi-section, tubular frames are sewn into closed hems at the end walls. Elastic shock cords extend through the frame sections. Tubular couplers and hinged end couplers contain the poles to form a right triangular profile. Collapsible longitudinal poles mount to pockets at the end walls and fasteners at the adjacent walls.

In one mounting arrangement, a reflective interior sidewall is exposed through the door to reflect solar/thermal radiation onto an insulated floor and/or user and maintain a warmed interior space. Upon inverting the walls through the door, the reflective wall can be positioned to reflect radiation away from the tent, with insulated, opaque interior side and floor walls maintaining a cool interior. Depending upon the numbers of users, the tent can be rotated to position either of the insulated walls as the floor and thereby provide greater or lesser floor space area. Multiple weatherproof, rotating vents having overlapping apertures are mounted to the tent to facilitate temperature control.

Still other objects, advantages and distinctions of the invention are more apparent from the following description with respect to the appended drawings. To the extent various modifications and improvements have been considered, they are described as appropriate. The description should not be literally construed in limitation of the invention which rather should be broadly construed in view of the further appended claims.

DESCRIPTION OF THE PREFERRED EMBODIMENT

Figure 1:
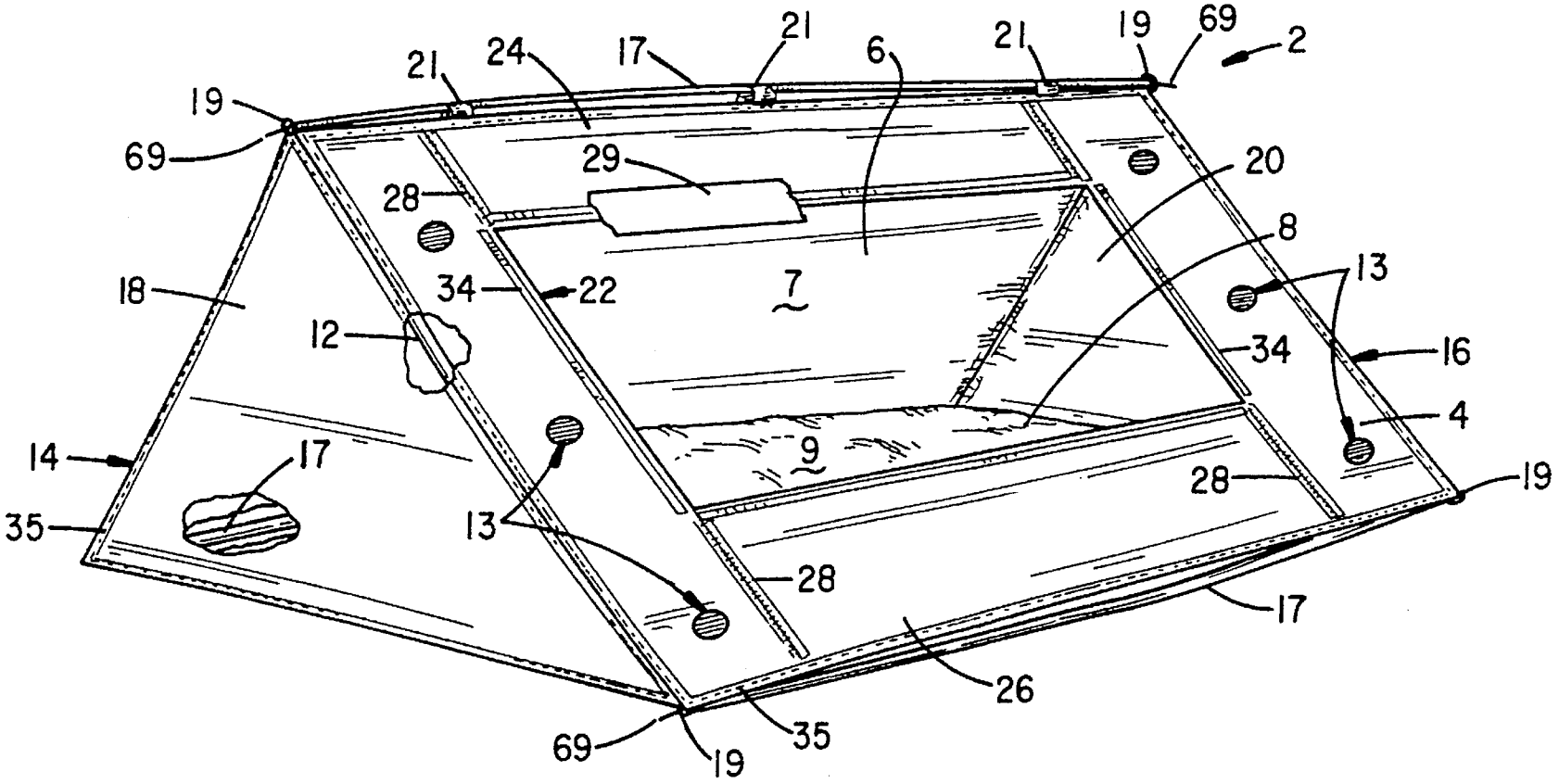
FIG. 1 is a perspective drawing of the tent shown in partial cutaway to expose the support frame and rotated for multi-person use.
Figure 2:
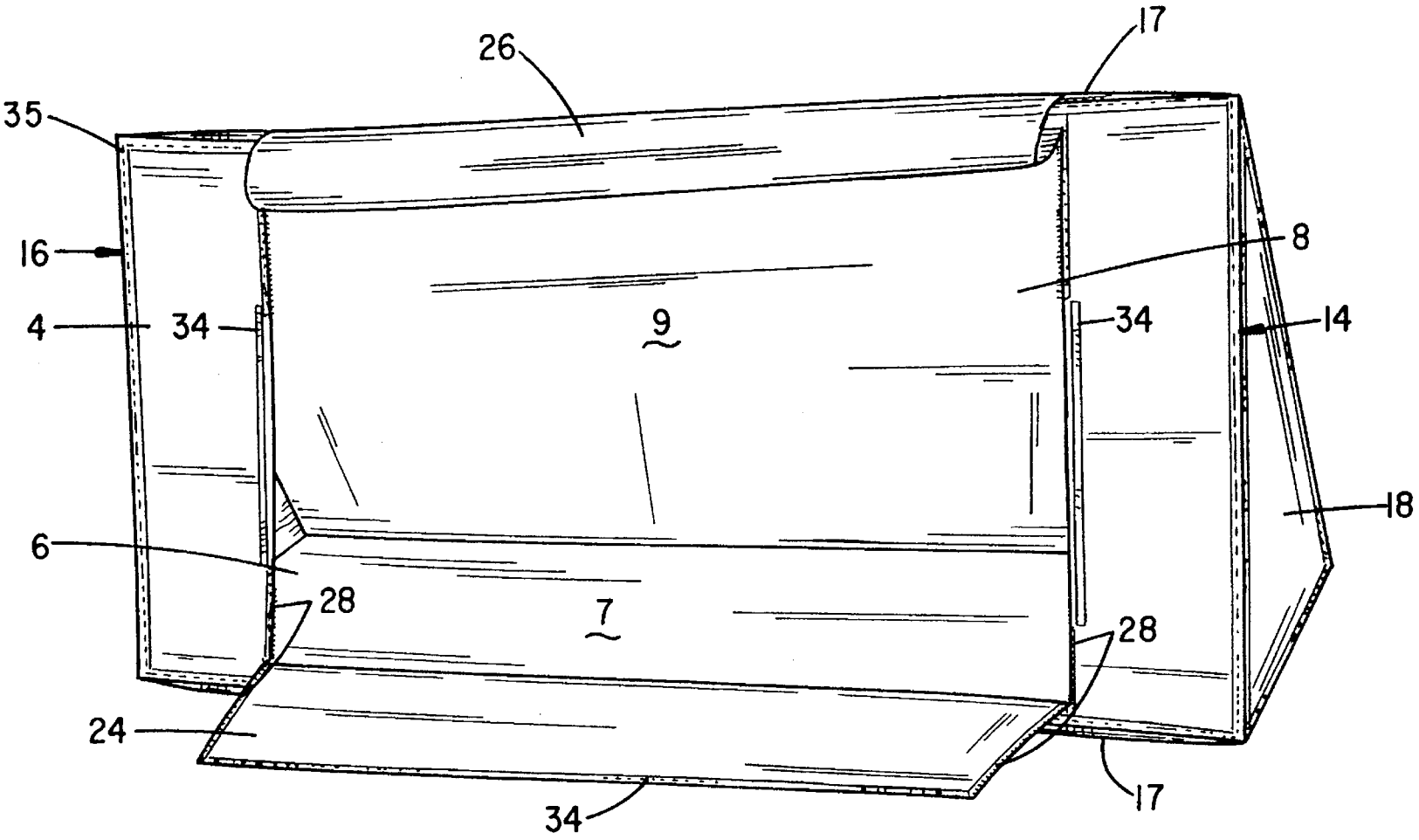
FIG. 2 is a front elevation view of the tent rotated for single person use and with the access flaps unfastened.
Figure 3:
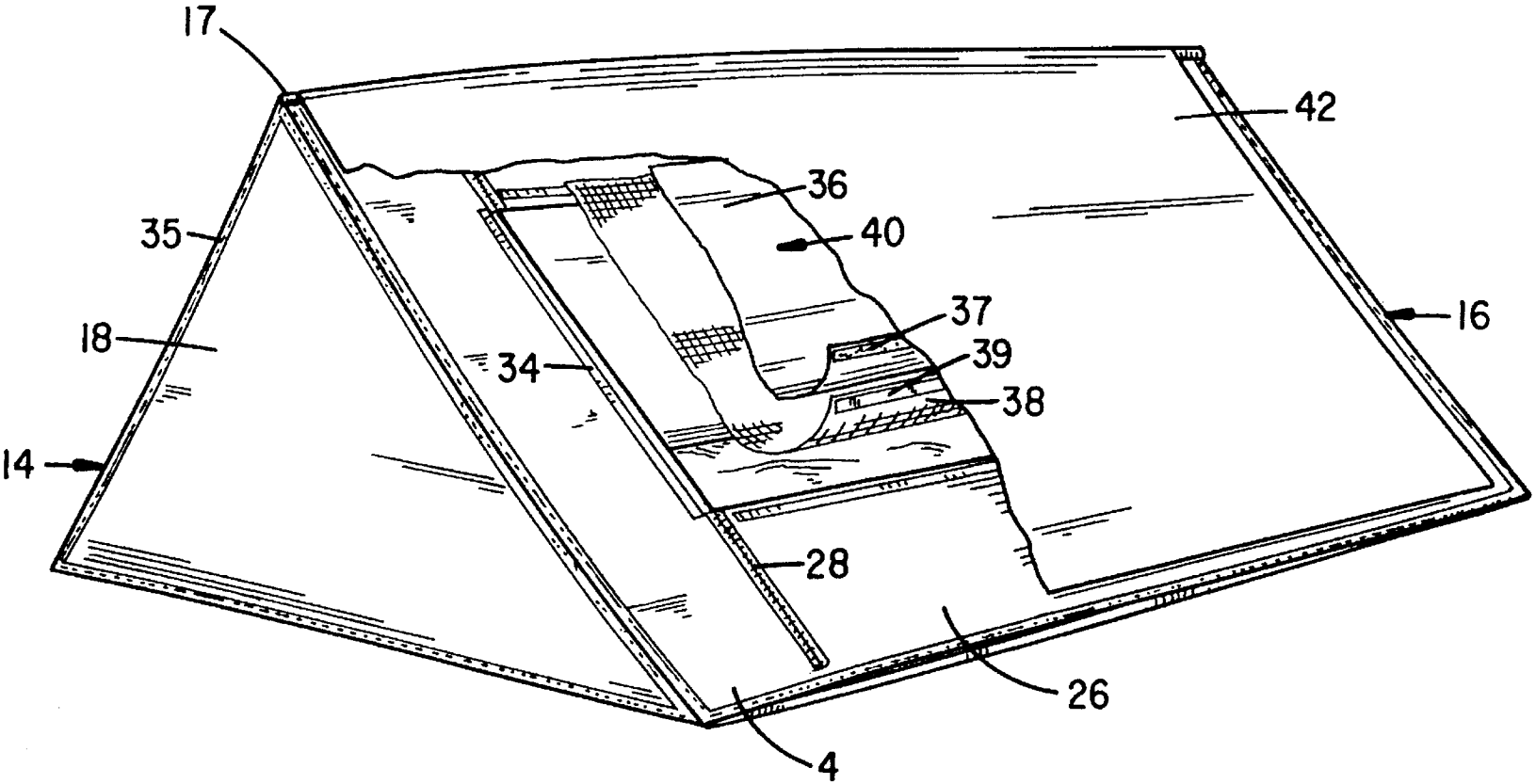
FIG. 3 is a view of the tent rotated for multi-person use and including removeable cover and screen panels and a rain fly.
Figure 4:
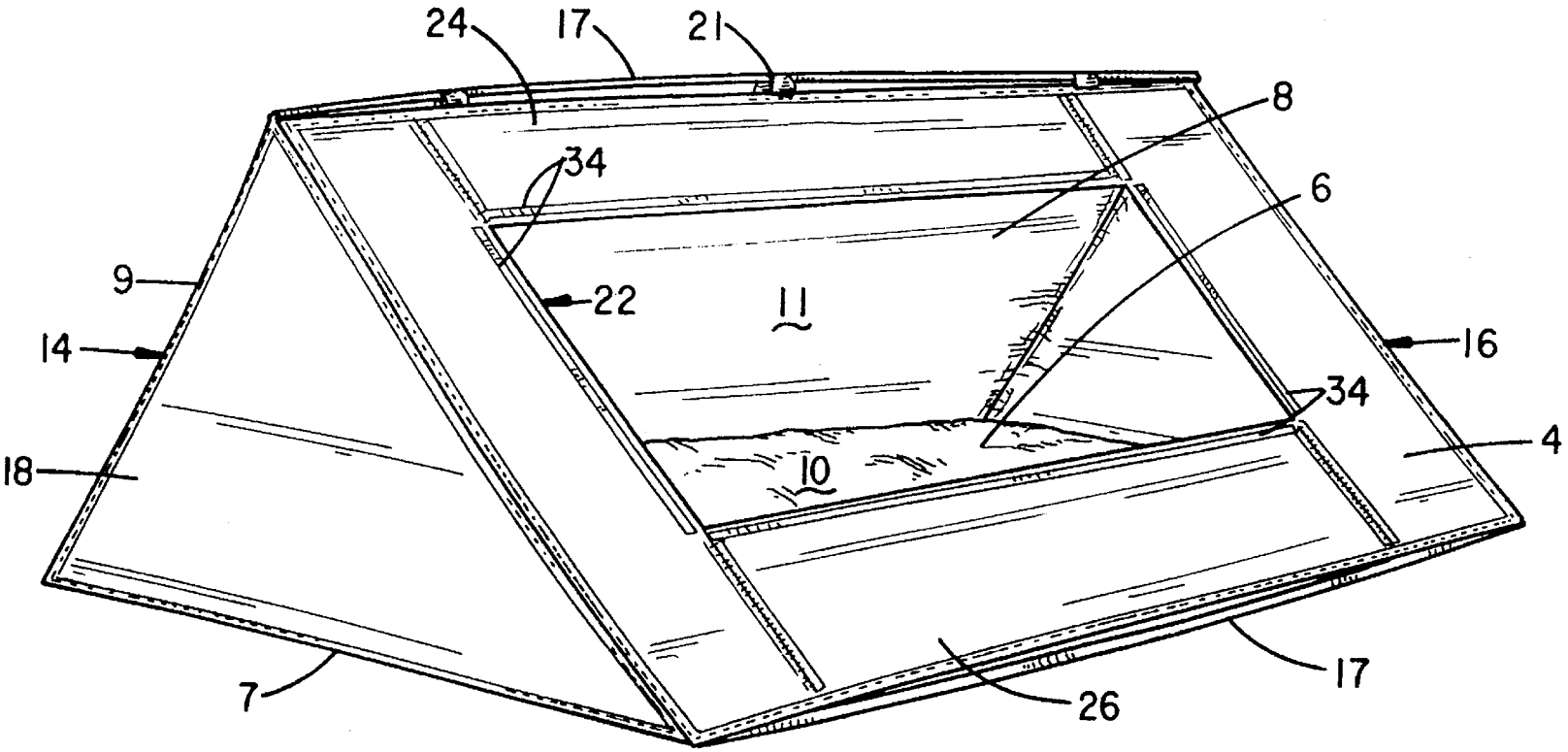
FIG. 4 is an end view of the tent rotated for multi-person use and with the sidewalls reversed to absorb radiation.

Referring to FIG. 1, a perspective drawing is shown to the multi-use solar tent 2 of the invention. The tent 2 is depicted in one of a number of mounting arrangements and some of which are shown at FIGS. 1–4. The tent 2 is adaptable to optimally permit assembly in relation to the season of the year and solar condition of any given day. For example, mounting arrangements are shown at FIGS. 1, 2 and 4, where the tent is respectively rotated for multi-person and single person use and the walls are positioned to optimally locate included reflective and absorptive surfaces and insulative layers.

The tent 2 finds application for one or more persons for use as an overnight sleeping shelter, a day shelter or as a sunbathing structure for controlling exposure to sun and weather. The tent may be used with or without a ground cloth (not shown). Depending upon the mounting position of a number of walls 4, 6, and 8, solar radiation and/or thermal radiation can be appropriately directed to control the internal conditions.

For example, FIGS. 1 and 2 depict arrangements of the tent 2 which accommodate differing numbers of occupants and where solar radiation and/or thermal radiation, such as from a fire, is collected and reflected internally. In the arrangement of FIG. 1, a reflective interior surface 7 at the insulated internal wall 6 reflects the radiation onto the reflective surface 9 of the insulated sidewall 6, which is positioned as a floor. Alternatively, the walls 6 and 8 can be rotated to reflect radiation from the surface 9 onto the surface 7.

The surfaces 7 and 9 can also be reversed to the outside of the tent to reflect solar radiation away from the tent 2, upon inverting the fabric through the door, reference FIG. 4. In this instance, the opposite, opaque, energy absorbing wall surfaces 10 and 11 are mounted internal to the tent 2 to maintain a relatively cool interior space. The tent walls may again also be rotated to accommodate the number of occupants. More of the details to the reversible properties of the tent 2 are apparent from the following description. In all mounting arrangements, the wall 4 serves as an access wall.

Fitted to the wall 4 are a number of vents 13. The vents 13 provide a pair of cover disks 3 which are secured to a center disk 5 at a center pivot. Inclined slots 15 are provided at the cover disks 3 which can be aligned to apertures at the center disk 5. Upon appropriately rotating the cover disks 3, the alignment of the slots 15 can be varied to control the exposure of the apertures of the center disk 5 and control the amount of ventilation of the interior space of the tent 2. Entry of moisture is prevented upon closing the vents 13 with the slots 15 directed down. The vents 13 may be fitted to any wall. Slits with fastened cover flaps (not shown) at the fabric walls might also be provided to vent the tent interior.

The tent 2 is constructed to store into a lightweight, relatively small bundle. A weight on the order of 8 to 10 pounds is obtained for the presently preferred construction and which stores to a cylindrical configuration approximately 28 to 36 inches long and 8 to 15 inches in diameter. The tent 2 may be used with or without a separate rain fly 42, reference FIG. 3. The fly 42 may be attached to the tent 2 or be separately supported above the tent 2.

Figure 5:
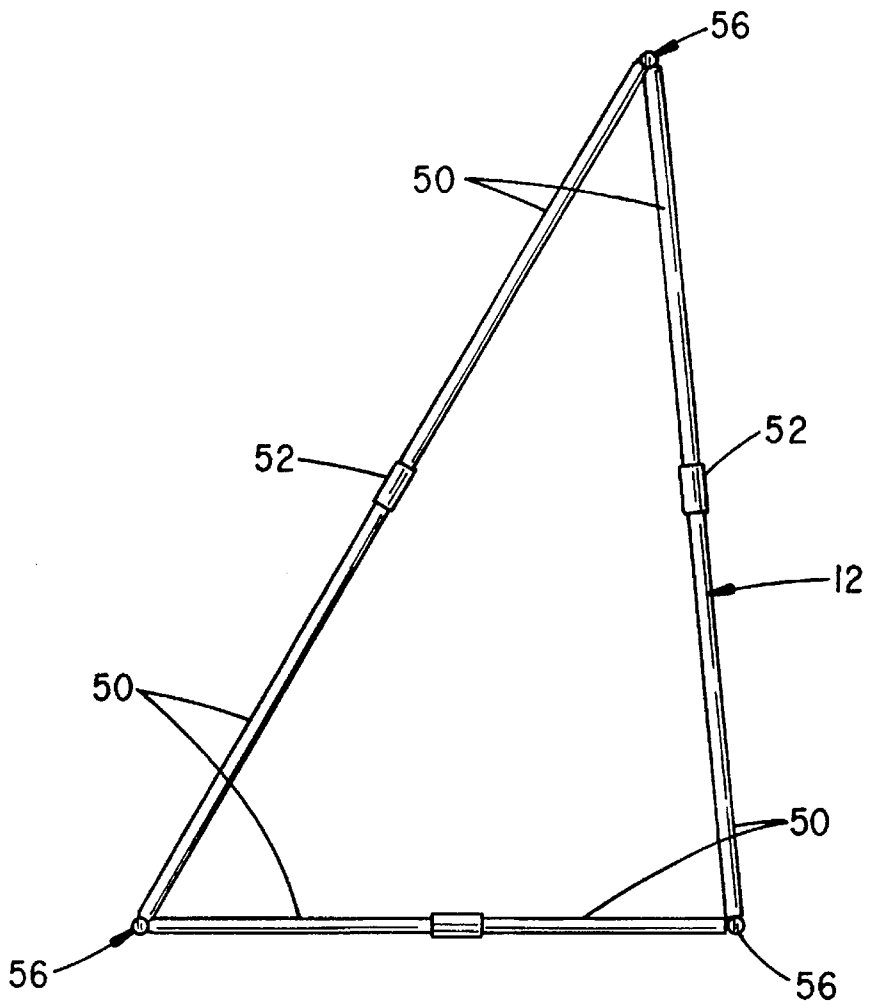
FIG. 5 is a view of an end support frame removed from the tent.
Figure 6:
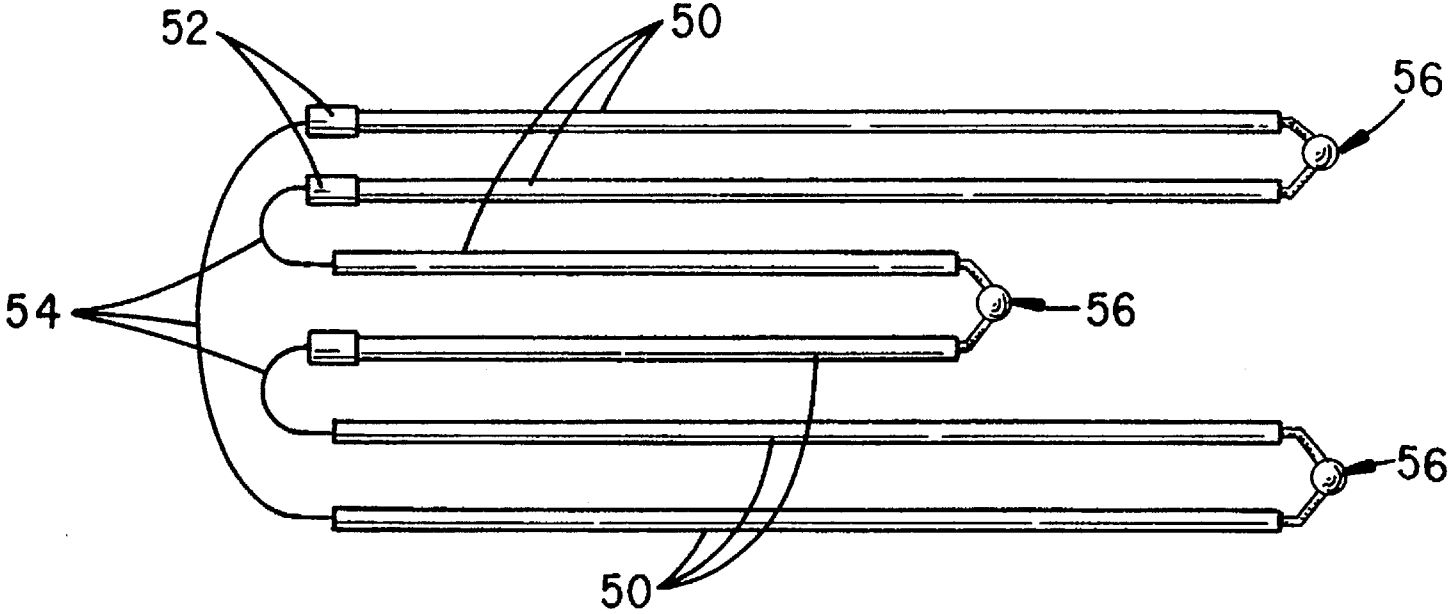
FIG. 6 is a view of the end support frame folded flat and without the fabric, prior to rolling the tent into a storage condition.
Figure 7:
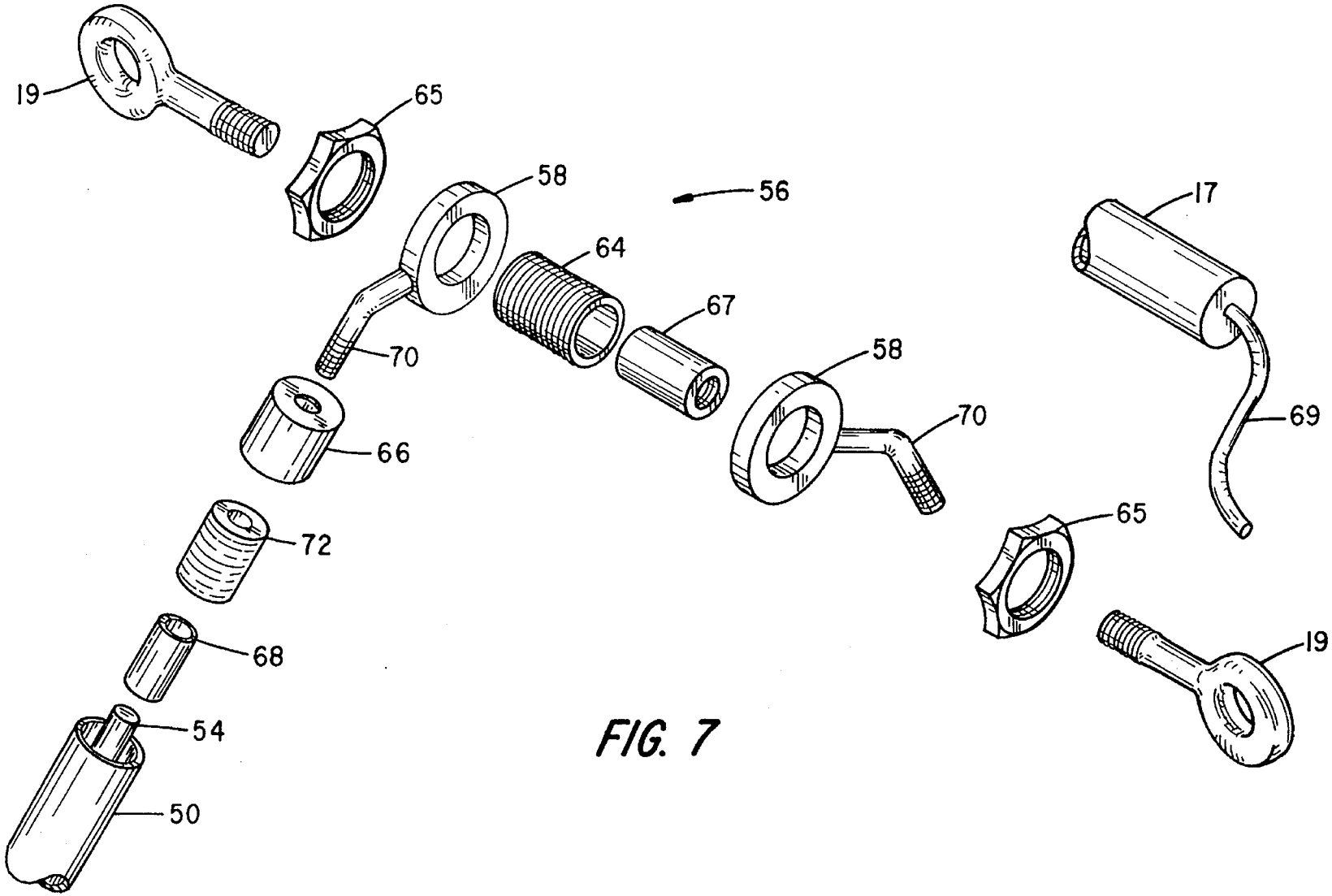
FIG. 7 is an exploded assembly drawing of a hinge joint at the support frame.

A self-contained support frame 12, shown in a cutaway panel, is contained at hemmed peripheral edges 14, 16 of a pair of opposite end walls 18 and 20, see also FIGS. 5, 6 and 7. The frame 12 disassembles and rolls up with the tent 2.

Separate multi-section, shock corded longitudinal poles 17 mount between the frames 12 and extend parallel to the juncture between the sidewalls 4,6; 4,8; and 6,8. One of the poles 17 is shown through a second cutaway panel. The ends of the poles 17 are retained to the tent 2 at eyes 19 at hinged apexes of the end frames 12, reference FIG. 7. Projecting, bent pins 69 mate with the eyes 19. The poles 17 may also be retained at sewn end pockets 22 which extend from the corners of the hems 14 and 16.

The poles 17 are secured along their lengths to the adjacent wall junctures with sleeves 21. "S" clips or other detachable fasteners might be used in lieu of sleeves 21 to facilitate detachment of the poles 17 during disassembly of the tent 2. Tabs having bound grommets might also be used in lieu of the sleeves 22 to receive the ends of the poles 17. The poles 17 might also be retained as hinged assemblies within hemmed pockets at the seams between the walls 4, 6 and 8.

The walls 4, 6 and 8 are arranged to provide an irregular triangular profile when viewed end-on, reference FIGS. 1, 2 and 5. That is, the frame 12 provides exemplary angular relationships in the range of 70–85 degrees between the walls 6,8; 15–35 degrees between the walls 4,8; and 60–80 degrees between the walls 4,6. The irregular nature of the frame facilitates energy reflection and absorption, while maintaining stability of the tent 2 under windy conditions.

Depending upon the rotation of the walls 6 and 8, either wall can serve as a floor or a reflective sidewall. FIGS. 1, 3 and 4 show the wall 8 positioned as the floor and FIG. 2 shows the wall 6 positioned as the floor. Depending upon which wall serves as the floor and the manner of reflection or absorption sought, the reflective surfaces 7, 9 and opaque surfaces 10, 11 are either positioned inside or outside the tent 2. As desired, the tent 2 is inverted by drawing the fabric and end frames 12 through a longitudinal access door 22 and re-assembling the tent 2 in normal fashion.

Figure 8:
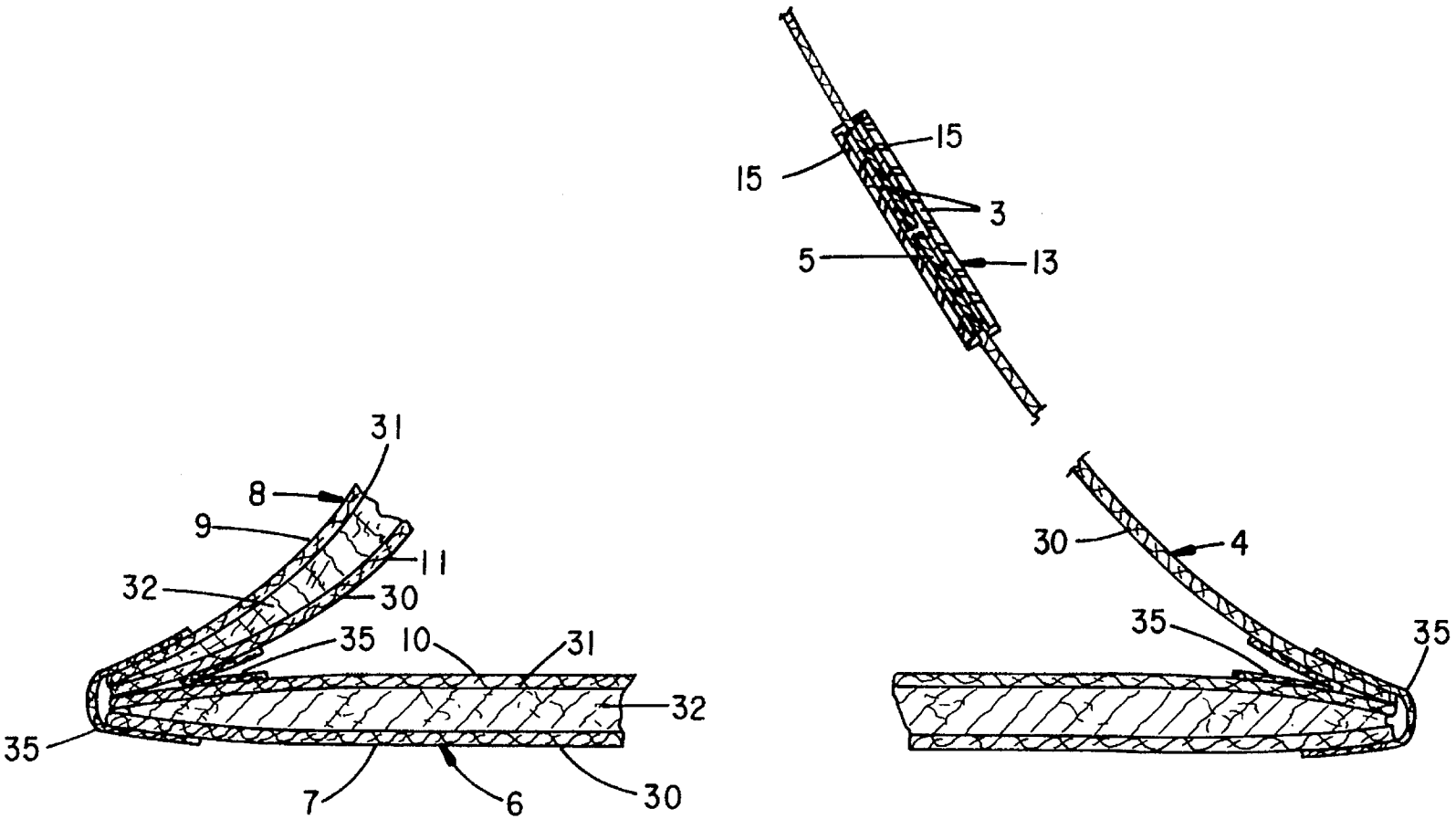
FIG. 8 is a cross section view through portions of the tent walls.

FIG. 8 depicts a cross section view through portions of the walls 4, 6 and 8. Each of the multi-layer walls 6 and 8 is constructed of a pair of light weight fabric or nylon layers 30, 31. A layer of insulative batting material 32, such as sold under the tradename HOLOFILL, QUOLOFILL or other thermally insulative material, is fitted between the layers 30, 31. The wall 4 includes only a single layer of fabric 30.

The surfaces 7 and 9 of the walls 6, 8 are coated with a reflective material, such as a weather resistant metal finish. Alternatively, the surfaces 10 and 11 may be dyed with suitable opaque colors to absorb radiated energy. An absorbant coating might also be applied to the surfaces 10 and 11 to enhance energy absorption. The end walls 18, 20 presently provide a single fabric layer, although either can also be constructed to include an insulated layer.

The layers 30, 31 and 32 of each wall 6 and 8 are sewn together at their peripheral edges. The stiching preferably is bound on both sides with strips of tape or moisture resistant fabric 35 to provide a weatherproof seam. A seam between the walls 6 and 8 may not be required if continuous pieces of material are used at the wall layers. Collective the metal surfaces 7 and 9 reflect radiation and the layers 32 insulate the opposite opaque layers 30 and energy absorbant surfaces 10 and 11 to define a preferential thermal barrier. With appropriate assembly of the walls 6 and 8, a user is able to provide an optimum internal space condition relative to changing seasonal and daily environmental conditions. A truly multi-season tent is thereby obtained.

The walls 4, 6, and 8 can be constructed to a variety of widths. Presently a tent construction on the order of 7 feet long, 4 feet tall and 38 inches wide is preferred. The tent length and height may however be changed as desired. The dimensions can be tailored in relation to the number of intended users and anticipated conditions. Although, too, an irregular triangular shape is preferred, other geometric shapes can be adapted to the invention. The features of the invention may also be incorporated into any number of existing geodesic tent configurations, where a door exposes an adjoining sidewall upon opening.

Sufficient interior space is available with the presently constructed tent 2 to accommodate 1 to 4 occupants and equipment. Larger constructions can be adapted with changes to the framing and the inclusion of additional frame supports to prevent sag at the front and sidewalls 4, 6, and 8.

In contrast to conventional tents, the longitudinal wall 4 includes the access door 22. Conventional tents typically provide access doors at the end walls. The door 22 is sized to provide sufficient collector area on the order of 60% to 80% of the surface area of the front 4. The door 22 is positioned along the longitudinal wall 4 to maximize the access opening. The increased dimensions of the opening facilitate entry and egress, but more significantly optimize collection of solar and thermal radiation entering the interior space 10 through the door 22. The reliefs may be formed to provide 100% exposure.

With the door 22 left open on a sunny day, an occupant is exposed full length to the sun, but without exposure to wind and drafts, which are blocked by the side and end walls. Such a mounting is advantageous for sunbathers or campers who merely want to enjoy the warmth of the day. Thermal radiation from a campfire can also be directed through the door 22 and from the interior wall surfaces 7, 9 onto the user or be absorbed at the wall surfaces 10, 11.

A pair of fastened flaps 24 and 26 are provided at the top and bottom longitudinal edges of the door 22. The flaps extend approximately 6 to 8 inches. The flaps 24, 26 are secured with fasteners 28 that extend to wall junctures adjacent the poles 15 and 17. The fasteners 28 can comprise zippers or lengths of mating hook and loop closures (i.e. VELCRO strips) magnetic/metallic strip fasteners, snap fasteners or combinations thereof, among others. Comparable fasteners 28 are used to retain an appropriate cover to the access door 22 which are discussed below. A cover flap 29, only one of which is shown, may be mounted to the flaps 24, 26 to cover the fasteners 28 or 34 against the weather.

FIG. 2 depicts both of the flaps 24, 26 opened to maximum exposure. The detachment of the flaps 24, 26 not only facilitates entry and egress, but also provides maximum exposure of the interior space to impinging solar and thermal radiation. With changing solar conditions, one or both of the flaps 24, 26 can be selectively opened and closed as preferred.

Fasteners 28 might also be included to expose the remaining wall material to either side of the door 22, thus permitting the entire wall 4 to be opened to collect solar radiation. A construction of the latter type has broad application for sunbathers and users who camp on lake or ocean shores.

Mounted to the wall 4 and/or to the flaps 24, 26 at the vertical and longitudinal peripheral edges of the door opening 22 are lengths of mating magnetic strip fasteners 34, reference FIGS. 3 and 4. The strip fasteners 34 are sewn or adhesively bound to the front wall 4. Selectively attached to the fasteners 34, is an opaque or transparent cover 36 and a screen panel 38. The panels 36 and 38 are presently provided as an assembly 40 and are attached together at their edges. The cover panel 36, which can be opaque or transparent, is fastened to the screen panel 38 with VELCRO fasteners. The screen panel 38 is fitted with a mating metallic stripping 39 that adheres to the magnetic stripping 34.

Figure 9:
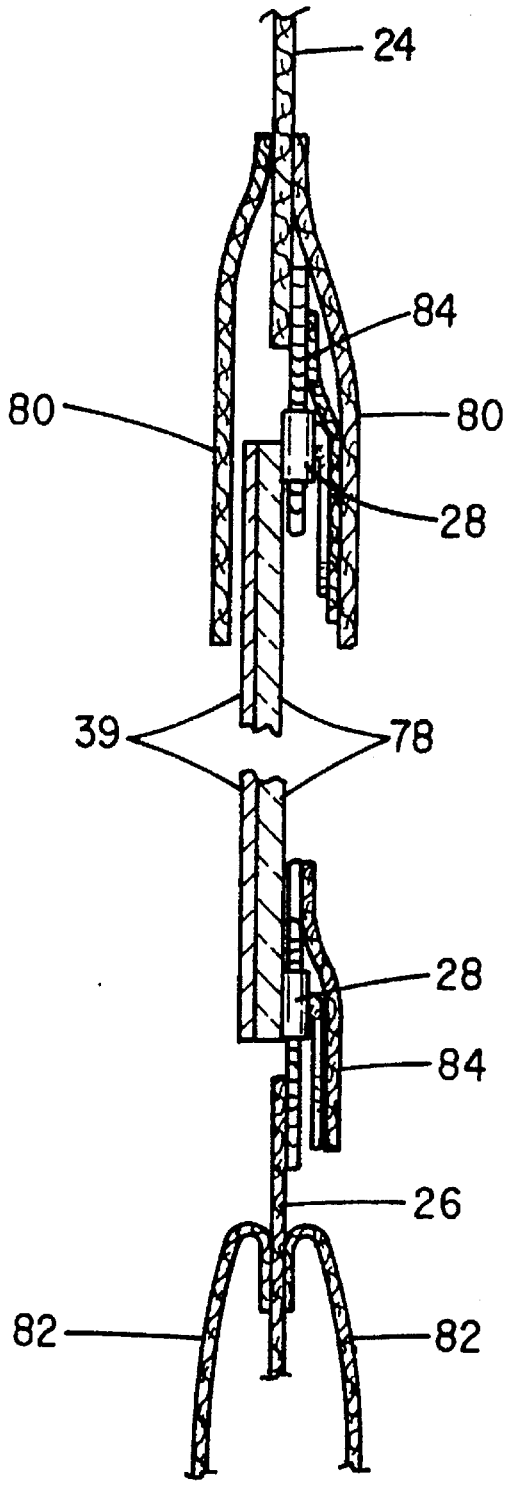
FIG. 9 is a cross section view through a removeable window panel.

In lieu of an assembly 40, a separate screen panel, transparent window or opaque cover panels, appropriately bordered with metal stripping 39 and/or zipper fasteners 28 or the like, might be attached to the door 22. FIG. 9 depicts a transparent window assembly which is fastened with zippers 28 to the flaps 24 and 26 and with the magnetic and metal stripping 34 and 39 to the vertical door edges. Comparable single panel windows, opaque covers or screens might be fitted to the particular fasteners 28 provided at the wall 4.

With attention to FIG. 9, the window cover assembly includes a transparent panel 78. Bound to the upper and lower longitudinal edges are zippers 28 which mate to zippers at the flaps 24, 26. Metallic strips 39 are fitted to the vertical edges of the panel 78. Pairs of fabric flaps 80 and 82 are retained to the flaps 24 and 26 and fabric flaps 84 are retained to the panel 78 to appropriately cover the fasteners 28 against the weather. The flaps 80, 82 and 84 are mounted to maintain weather tight seams at the various reversible and rotatable mountings of the tent 2. In lieu of merely being transparent, the panel 78 can also be coated with a variety of materials to control reflection and selectively limit viewing through the panel.

The assembly 40 and panels 36, 38 can be selectively attached to the wall 4 and exposed to accommodate the prevailing conditions. Upon attaching the screen panel 38 to the fastener strips 34, the cover panel 36 can be left in a lowered condition to cover the door 22. Alternatively, the cover 36 can be folded or tied back to allow circulation through the screen panel 38. Associated tie straps (not shown) may also be provided at the wall 4 in conventional fashion or assembly 40 and which can be fastened to hold the assembly 40 and/or panels 36, 38 tight to the wall or folded back.

A rain fly 42 might also be provided with the tent. The fly 42 can be separately staked in conventional fashion over the tent 2 to provide a weather cover for the entire tent 2. Alternatively, the fly 42 can be secured to the tent 2 to cover the door area as depicted. In the latter instance, strips of hook and loop or VELCRO fasteners can be appropriately attached to the wall 4 and fly 42 to retain one to the other.

Turning attention to FIGS. 5, 6 and 7, detailed views are provided to the end support frames 12. FIG. 5 depicts a view of the frame 12 erected to an irregular triangular form and FIG. 6 depicts the frame 12 disassembled and folded flat. Each frame 12 is constructed of a pair of tubular sections 50 which fit to one another at tubular sleeve couplers 52. Elastic shock cords 54 mount inside the bores of the tubular sections 50 and are crimped to mating hinge assemblies 56. The lengths and numbers of sections 50 is established depending upon the lengths of the walls 4, 6 and 8. Gussets or reliefs or enlarged pockets can be provided at the hems 14, 16 to facilitate folding the frames 12 at the hinged joints 56.

FIG. 7 depicts an exploded assembly drawing to one of the hinge assemblies 56. Each assembly 56, only one of which is shown, couples the pole sections 50 of two of the walls to each other at a rigid hinge point. A pair of eyelets 58 extend from the adjoining pole sections 50 and are bound together with a threaded sleeve 64 and lock nuts 65. A plastic liner 67 is contained within the sleeve 64, threads provided at an internal bore mate with eye bolts 19 that extend from the joint. The bent pin 69 at each pole 17 mounts within an eye 19 which is exposed through the tent end walls.

Each eyelet 58 mounts within its associated pole section 50 through an end cap 66. A plug piece 68 is fitted to the section 50 and restrains a portion of the shank 70 of the eyelet 58 to the section 50. The plug may include a serrated surface to facilitate adhesion or be secured with a hot melt glue to the section 50. An end portion of an eyelet shank 70 projects through the plug 68 and is crimped to the cord 54 at a crimp connector 72.

Two end frames 12 are believed adequate for the intended typical conditions of the tent 2. As required, straps (now shown) may be fitted to the walls and staked to the ground near the tent 2 to prevent collapse under high wind conditions. Alternatively, one or more additional frames 12 can be provided along the length of the tent 2 at separate intermediate hems in the walls 4, 6 and 8.

While the invention has been described with respect to a presently preferred triangular tent construction and considered modifications and improvements, still other constructions might be suggested to those skilled in the art. The foregoing description should therefore not be construed in limitation of the invention. The scope of the invention should instead be broadly construed from the following claims.

What is claimed is:

1. A tent comprising:

a) a fabric covering including a plurality of longitudinal walls and end walls, wherein a first longitudinal wall has an access opening, and wherein said longitudinal walls are sewn to said end walls;

b) first and second frames and means for retaining said first and second frames to said first and second end walls, wherein each of said first and second frames comprises a plurality of tubular sections, wherein an elastic cord extends through the tubular sections of each of said first and second frames, a plurality of coupler means for securing adjoining tubular sections to one another, and a plurality of hinge means for coupling the ends of a plurality of said tubular sections to define a plurality of apexes of said first and second frames, wherein each hinge means comprises first and second eyelets mounted to an end of one of said tubular sections and secured to said elastic cord and hinge pin means for retaining said first and second eyelets to one another, whereby said first and second frames can be collapsed and said fabric covering can be drawn through the access opening to expose opposite surfaces of the longitudinal and ends walls to the elements.

2. The tent of claim 1 wherein said first and second frames are mounted in hemmed sleeves at adjoining borders of said longitudinal and end walls.

3. The tent of claim 1 wherein a plurality of poles extend between the apexes of said first and second frames and wherein each of said plurality of hinge means includes a third eyelet which receives a retainer pin that extends from an end of one of said poles.

4. The tent of claim 3 wherein said first and second frames are mounted to hemmed sleeves at said end walls, wherein second and third longitudinal walls each comprise multiple layers of material including, a reflective layer having a solar reflective surface, an opaque layer having an energy absorbant surface and a thermal insulating layer mounted between said reflective and opaque layers.

5. The tent of claim 4 wherein the reflective surfaces of said second and third longitudinal walls adjoin one another.

6. The tent of claim 4 wherein the reflective surface comprises a solar reflective coating and wherein the energy absorbant surface comprises an energy absorbant coating.

7. The tent of claim 3 wherein the first wall includes a plurality of fasteners which selectively retain at least first and second flaps that define peripheral edges of said access opening.

8. The tent of claim 3 wherein the cover is transparent.

9. The tent of claim 3 including a cover for said access opening and wherein the cover includes a screen layer and an opaque layer and means for fastening said screen and opaque layers to one another.

10. The tent of claim 3 wherein said fabric covering includes means for venting the interior of said tent.

11. A tent comprising:

a) a fabric covering including a plurality of walls, wherein a first wall includes an access opening, wherein second and third walls each comprise stacked layers of material including, a reflective layer having a solar reflective surface, an opaque layer having an energy absorbant surface and a thermal insulating layer mounted between said reflective and opaque layers;

b) first and second frames mounted within hemmed sleeves at said walls and a plurality of poles mounted between said first and second frame, wherein each of said first and second frames comprises a plurality of tubular sections, wherein an elastic cord extends through each of said first and second frames, wherein a plurality of coupler means secure adjoining tubular sections to one another, wherein a plurality of hinge means couple the ends of a plurality of said tubular sections to define a plurality of apexes of said first and second frames, and wherein each hinge means comprises a first and second eyelet mounted to respective ends of adjoining ones of said tubular sections and secured to said elastic cord and hinge pin means for retaining said first and second eyelets to one another, and a third eyelet which receives a retainer pin that extends from an end of one of said plurality of poles, whereby said first and second frames can be collapsed and said solar reflective and energy absorbant layers can be selectively exposed to the elements upon drawing said first and second frames and the fabric covering through the access opening; and c) a cover for said access opening.

12. A tent comprising:

a) a fabric covering including a plurality of walls, wherein a first wall has an access opening, wherein second and third walls each include a solar reflective surface on one side and an energy absorbing surface on an opposite side;

b) a plurality of first poles having frame retainer means secured to opposite ends of said first poles and first and second support frames mounted to said walls comprising a plurality of tubular second poles and an elastic cord mounted through said second poles, wherein a plurality of hinge means couple a plurality of said second poles to one another, wherein each hinge means comprises a first and second eyelet mounted to respective ends of adjoining ones of said second poles and secured to the elastic cord and including hinge pin means for retaining said first and second eyelets to one another, and wherein said frame retainer means secures said first poles between selected ones of the hinge means at said first and second frames, whereby said first and second frames can be collapsed and said solar reflective and energy absorbant layers can be selectively exposed to the elements upon drawing said first and second frames and the fabric covering through the access opening; and c) a cover for said access opening.

13. The tent of claim 12 wherein said hinge means includes a third eyelet and said frame retainer means comprise first and second pins which project from said second poles and mounts to said third eyelet.

14. The tent of claim 12 wherein said second and third walls each comprise multiple layers of material, including a reflective layer having a solar reflective surface, an opaque layer having an energy absorbant surface and a thermal insulating layer mounted between said reflective and opaque layers.

15. The tent of claim 12 wherein the cover includes a screen layer and an opaque layer and means for fastening said screen and opaque layers to one another.

16. The tent of claim 12 wherein the first wall includes a plurality of fasteners which selectively retain at least first and second flaps that define peripheral edges of said opening.

17. The tent of claim 12 wherein said fabric covering includes means for venting the interior of said tent.

* * * * *